US009382785B2

(12) United States Patent
Wells et al.

(10) Patent No.: US 9,382,785 B2
(45) Date of Patent: Jul. 5, 2016

(54) SHAPED MEMORY DEVICES AND METHOD FOR USING SAME IN WELLBORES

(71) Applicants: Dan M. Wells, Houston, TX (US); Jason J. Barnard, Katy, TX (US)

(72) Inventors: Dan M. Wells, Houston, TX (US); Jason J. Barnard, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 408 days.

(21) Appl. No.: 13/919,568

(22) Filed: Jun. 17, 2013

(65) Prior Publication Data

US 2014/0367106 A1 Dec. 18, 2014

(51) Int. Cl.
*E21B 43/12* (2006.01)
*E21B 29/10* (2006.01)

(52) U.S. Cl.
CPC ..... *E21B 43/12* (2013.01); *E21B 29/10* (2013.01)

(58) Field of Classification Search
CPC ..... E21B 33/12
See application file for complete search history.

(56) References Cited

U.S. PATENT DOCUMENTS

| | | | |
|---|---|---|---|
| 6,216,779 | B1 | 4/2001 | Reinhardt |
| 7,831,133 | B2 | 11/2010 | Sandberg et al. |
| 8,146,669 | B2 | 4/2012 | Mason |
| 8,256,512 | B2 | 9/2012 | Stanecki |
| 8,267,185 | B2 | 9/2012 | Ocampos et al. |
| 8,327,681 | B2 | 12/2012 | Davidson et al. |
| 8,353,347 | B2 | 1/2013 | Mason |
| 2007/0144731 | A1 | 6/2007 | Murray |
| 2009/0151957 | A1* | 6/2009 | Sickle ..... E21B 33/12 166/373 |
| 2011/0146265 | A1 | 6/2011 | Joseph |
| 2012/0055667 | A1* | 3/2012 | Ingram ..... E21B 33/1208 166/65.1 |
| 2012/0103604 | A1 | 5/2012 | Mohamed et al. |

FOREIGN PATENT DOCUMENTS

| | | | |
|---|---|---|---|
| WO | WO2007121350 | A1 | 10/2007 |
| WO | WO2010127240 | A1 | 11/2010 |

OTHER PUBLICATIONS

International Search Report and Written Opinion for International Application No. PCT/US2014/038414; International Filing Date May 16, 2014: Mail Date Sep. 17, 2014. (13 pages).

* cited by examiner

*Primary Examiner* — Kenneth L Thompson
*Assistant Examiner* — Steven MacDonald
(74) *Attorney, Agent, or Firm* — Cantor Colburn LLP

(57) ABSTRACT

In one aspect an apparatus for use in a wellbore is disclosed that in one embodiment includes a device or tool conveyable in the wellbore, wherein the device or tool further includes a shape memory member formed into a compressed state, the shape memory device having a glass transition temperature and a heating device associated with the shape memory member configured to heat in the wellbore the shape memory member to or above the glass transition temperature to expand the shape memory member to a second expanded state.

20 Claims, 2 Drawing Sheets

SHAPED MEMORY DEVICES AND METHOD FOR USING SAME IN WELLBORES

BACKGROUND

1. Field of the Disclosure

The disclosure relates generally to apparatus and methods for installing shape memory devices in wellbores.

2. Description of the Related Art

Hydrocarbons, such as oil and gas, are recovered from subterranean formations using a well or wellbore drilled into such formations. In some cases the wellbore is completed by placing a casing along the wellbore length and perforating the casing adjacent each production zone (hydrocarbon bearing zone) to extract fluids (such as oil and gas) from such a production zone. In other cases, the wellbore may be an open hole, which may be used to produce hydrocarbons or inject steam or other substances into a geological formation. One or more flow control devices are placed in the wellbore to control the flow of fluids from the formation into the wellbore. These flow control devices and production zones are generally fluidly isolated or separated from each other by installing a packer between them. Other devices also are utilized to temporarily plug sections of a wellbore or to control flow of fluids through the wellbore or a production string deployed to convey formation fluid to the surface. Certain devices having shape memory materials (shape memory devices) have been disclosed and utilized in wellbores for such purposes. A shape memory material can be heated to or above its glass transition temperature to attain a selected or desired expanded shape or state and then compressed to desired compressed shape to retain it in such compressed shape at temperatures below the glass transition temperature. When the shape material is again heated to or above its glass transition temperature, it expands to the expanded shape. For wellbore applications, a shape memory material or member, which may be a part of a device or tool, is typically formed in a compressed state and then deployed in the wellbore. The wellbores typically contain a fluid, such as a drilling or another fluid and are often at a temperature above the glass transition temperature of the shape memory material. The shape memory device deployed in the wellbore heats over time and attains the expanded shape. However, in certain wells, the temperature is not sufficiently high to heat the shape memory device above its glass transition temperature or the heating process may take a relatively long time to cause the shape memory device to expand. It is thus desirable to have devices in the wellbore to controllably heat the shape memory devices in the wellbore to cause the shape memory materials to attain their expanded shapes.

The present disclosure provides shape memory devices and systems for controllably heating and setting such shape memory device in wellbores.

SUMMARY

In one aspect an apparatus for use in a wellbore is disclosed that in one embodiment includes a downhole tool or device conveyable in the wellbore, wherein the downhole tool or device further includes a shape memory member in a compressed shape or state, the shape memory member having a glass transition temperature and a heating device configured to heat in the wellbore the shape memory member to or above the glass transition temperature to expand the shape memory member to an expanded shape or state.

In another aspect, a method of providing an apparatus for use in a wellbore is disclosed that in one embodiment may include: providing a device having a shape memory member in a compressed state; placing a heating element proximate or in the shape memory member; and providing a source that supplies electrical energy to the heating element to heat the shape memory to an expanded state.

Examples of some features of the disclosure have been summarized rather broadly in order that detailed description thereof that follows may be better understood, and in order that some of the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters generally designate like or similar elements throughout the several figures, and wherein.

DETAILED DESCRIPTION OF THE DISCLOSURE

Figure 1:
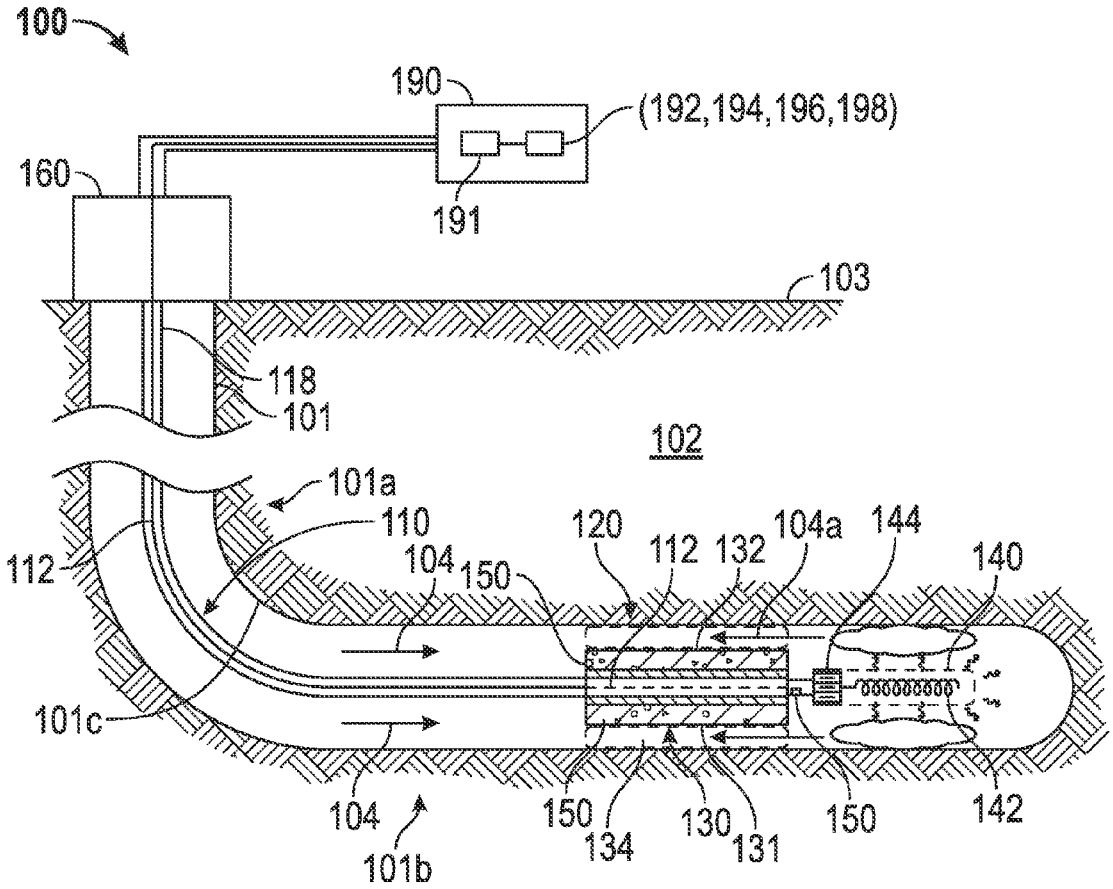
FIG. 1 is a schematic elevation view of an exemplary wellbore system wherein a work string containing a shape memory device made according to one embodiment of the disclosure is deployed in a wellbore.

The present disclosure relates to devices and methods for controlling production of hydrocarbons in wellbores. The present disclosure is susceptible to embodiments of different forms. There are shown in the drawings, and herein described, specific embodiments of the present disclosure with the understanding that the present disclosure is to be considered an exemplification of the principles of the devices and methods described herein and is not intended to limit the disclosure to the specific embodiments. Also, the feature or a combination of features should not be construed as essential unless expressly stated as essential.

FIG. 1 shows an exemplary wellbore system 100 that includes a wellbore 101 drilled through an earth formation 102 from a surface location 103 for producing hydrocarbons from the formation 102. The wellbore 101 is shown as an open hole, i.e., without any casing therein. The wellbore 101 is shown to include a vertical section 101*a* and a deviated or substantially horizontal section 101*b*. The wellbore system 100 includes a work string 110 that includes a downhole assembly 120 conveyed in the wellbore 101 by a conveying member 118, such as a wireline or a coiled tubing. The wellbore system 100 further includes a wellhead unit 160 through which the conveying member 118 and the downhole assembly 120 are deployed into the wellbore 101. The wellbore 101 is further shown to contain a fluid 104, such as a drilling fluid.

Still referring to FIG. 1, the downhole assembly 120, in one aspect, includes a shape memory device 130, which device is desired to be placed or installed in the wellbore. In aspects, the shape memory device 130 may include a suitable shape memory material or member known in the art. A shape memory member or material, for the purpose of this disclosure, is a material device that may be heated to or above its glass transition temperature to an expanded shape and then compressed to a compressed shape and cooled to retain the compressed shape until reheated to or above its glass transition temperature to case it to attain its expanded shape. Shape memory materials are known in the art and are thus not described in detail herein. Any suitable shape memory, however, included, but not limited to polymers, may be utilized. The shape memory device 130 is shown conveyed and placed in the wellbore 101 at a location where it is desired to be expanded and set. The particular shape memory device 130 has outer dimensions 131 when it is in the compressed state. The device 130 when heated to or above the glass transition temperature of its shape memory material will expand to contact and press against the wellbore wall 101*c* and attain the expanded shape as shown by dimensions 134.

The downhole assembly 120 further includes a heating device 140 that includes a heating element 142 and a source 144 for supplying electric energy or power to the heating element 142. The heating element may be made in the form of a coil, metallic strips or may have any other form known in the art. In one aspect, the electric energy source may be a battery 144 electrically coupled to the heating element 142 placed in the downhole assembly 130. In one aspect, the heating element may be placed downhole or below the shape memory device 130, whereas the battery 144 may be placed either uphole (above) or downhole of the shape memory device 130. In another aspect, the heating device 140 may be removably mounted in the downhole assembly 120, such that after setting or expanding the shape memory device 130 in the wellbore, the heating element 142 and the battery 144 may be retrieved to the surface 103. In another aspect, the electrical energy to the heating element 142 may be supplied from a surface source 191 via an electrical line 112 running through the conveying member 118. One or more temperature sensors, such as sensors 150, may be placed at suitable locations in the downhole assembly 120 to provide temperature measurements proximate the shape memory device 130.

Still referring to FIG. 1, the system 100 further includes a surface unit 190, which may be a computer-based system that may further include electrical circuits 192 to pre-process sensor signals, a processor 194, such as a microprocessor, one or more storage devices 196, such as memory devices, and programs 198 that include instructions accessible to the processor 192 for executing such instructions.

After setting or placing the downhole assembly 120 at the desired location in the wellbore 101, the control unit 190 may cause the electric energy source 144 or 191 at the surface to supply electrical energy to the heating element 142. When the heating element is heated, the fluid 104 proximate the heating element is heated, which fluid causes the shape memory member to heat. The controller 190 determines the temperature of the fluid from the signals provided by the temperature sensor 150 and may control the supply of the electrical energy to the heating element 142 and thus the temperature of the heating element to cause the temperature of the shape memory member to rise to or above the glass transition temperature of the shape memory member. After the shape memory member has attained the desired expanded state or after a selected time period, the controller 190 may stop supplying the electrical energy to the heating element 142 (i.e., deactivate the heating element). The conveying member 118 may then be dislodged from the shape memory at a connection point 136 and retrieved to the surface 103 with the heating element 142 and the battery 144. In other aspects, the heating element and the battery may not be detachable element and thus may be left in the wellbore 101.

Figure 2:
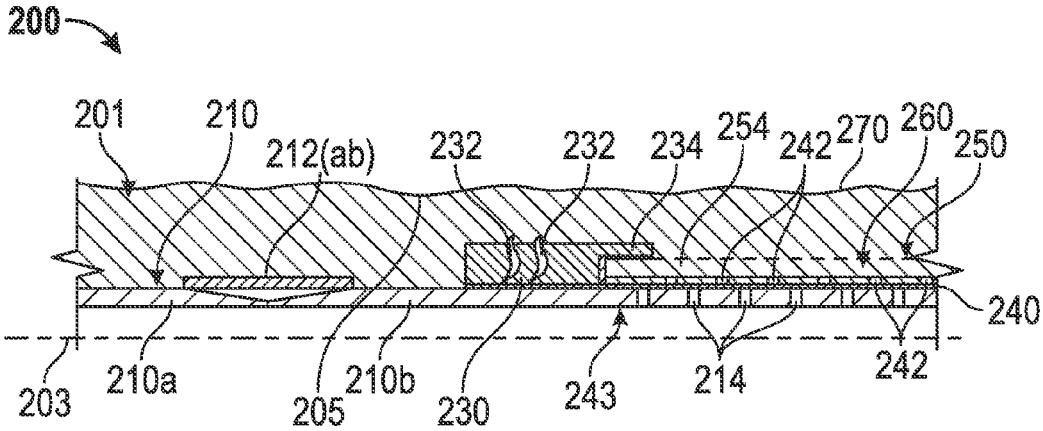
FIG. 2 shows a sectional side view of a shape memory device made according to one embodiment the disclosure and placed on a base pipe in a wellbore.

FIG. 2 shows a sectional side view of a shape memory device 200 made according to one embodiment of the disclosure and placed around a base pipe or tubing 210 having an axis 203. The base pipe 210, which may extend from a surface location into the wellbore, may be formed by axially joining base pipe sections, such as sections 210*a*, 210*b*, etc. Adjoining base pipe sections, such as 210*a* and 210*b*, may be joined by any suitable mechanical connection, such as a connector 212*ab* known in the art. The base pipe 210 includes a number of fluid passages 214 over a selected base pipe length to allow flow of fluid from the formation into the base pipe. In the particular embodiment of FIG. 2, the exemplary shape memory device 200 is shown as a packer, but it may be made into any other suitable shape or form according to the principles described herein. The shape memory device 200 includes a shape memory member (also sometimes referred to as an element or a material) 250 surrounding a tubular 240, which tubular may be made from any suitable material, such as steel or another suitable alloy. The tubular 240 includes a number of fluid passages 242 that allow a fluid passing through the shape memory element 250 to pass into the base pipe 210. The shape memory member 250 is shown in the compressed state having outer dimensions 260. The tubular 240 may include any number of fluid passages 242 to enable a fluid to pass from outside of the shape memory member 250 to inside 243 of the tubular 240. In one aspect, ends, such as end 254 of the shape memory device 200 may be securely inserted into a side pocket 234 of a centralizer 230 to form a unified assembly. The unified assembly may then be inserted over the base pipe 210 and secured thereon by suitable attachments, such as screws 232. The shape memory member or element 250, when heated in the wellbore by a device made according to an embodiment or principles described herein, will expand to attain an expanded shape 270 and press against inside 205 of the wellbore 201. The shape memory device 200 further includes a heating element as described in reference to FIG. 1 or FIGS. 3-5 described below.

Figure 3:
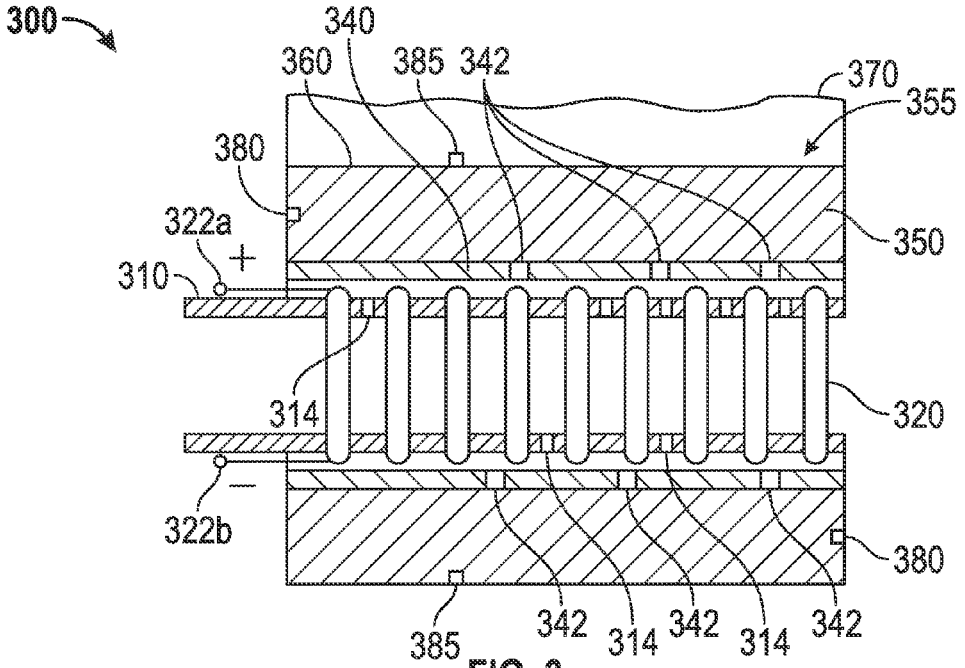
FIG. 3 shows shape memory device made according to another embodiment of the disclosure that includes a heating element installed on a base pipe, such as the base pipe shown in FIG. 3.

FIG. 3 shows a shape memory device 300 made according to another embodiment of the disclosure. FIG. 3 shows a base pipe 310 having a number of perforations of fluid passages 314. A heating element 320, such as a coil, may be wrapped around the base pipe 310 about the fluid passages 314. Alternatively, the heating element may be formed in the form of metallic strips and placed on the base pipe 310. Electric energy to the heating element 320 may be supplied from an energy source, such as a battery or a source at the surface 191, via terminals 322*a* and 222*b*, as described in reference to FIG. 1. The shape memory device 300 further includes a shape memory member or material 350 placed around a tubular member 340 having perforations or fluid passages 342. The combination of the tubular 340 and the shape memory member 350 may be formed as unitary member or device 355 that can be placed or slipped over the heating element 320. In such a configuration, the shape memory device 300 includes a heating element 320 placed on the base pipe 310 and a unitary device 355 that includes the shape memory material 350 on a tubular 340. The unitary member 355 is placed on the heating element 320 in a compressed state or shape 360 and conveyed into the wellbore to a selected depth. When electrical energy is supplied to the heating element 320, i.e., when the heating element 350 is activated, such as by the surface control unit 190, FIG. 1, or a timing device downhole, heat conducts from the heating element 320 to the tubular 340, which heats the shape memory material 350 to or above its glass transition temperature. The shape memory material 350 then expands from its compressed state or shape 360 to an expanded state or shape 370 and presses against the wellbore wall. Temperature sensors 380 placed at one or more suitable locations on or proximate the shape memory device may be utilized to control the electrical energy and timing thereof to controllably activate the shape memory device in the wellbore. Additionally, one or more pressure sensors 385 may be provided to determine pressure applied by the shape memory device on another element, such as wellbore wall to determine the adequacy of the contact between the shape memory device 300 and the wellbore wall. In aspects, the control unit 190 may determine the temperature from temperature sensors 180 and/or pressure from the pressure sensors and control heating of the shape memory member 350.

Figure 4:
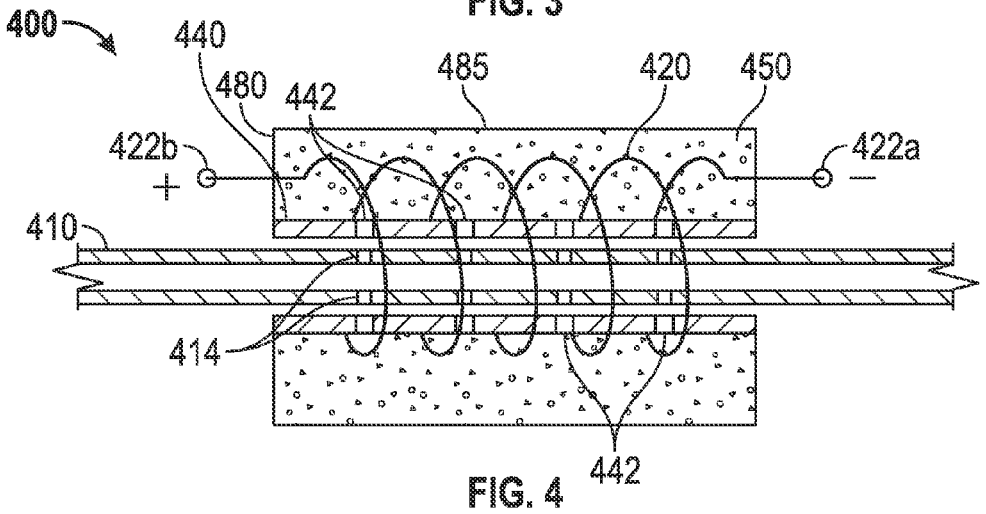
FIG. 4 shows a shape memory device that includes a coil embedded in the shape memory material to heat such material, according to yet other embodiment of the disclosure.

FIG. 4 shows a shape memory device 400 made according to yet another embodiment of the disclosure. The shape memory device 400 is shown placed around fluid passages 414 in a base pipe 410. In one aspect, the shape memory device 400 includes a shape memory member or material 450 placed or attached around a tubular 440 having fluid flow passages 442. A heating element 420 is embedded or partially embedded in the shape memory material 450 during manufacturing of the shape memory device 400. The electrical energy to the heating element 420 may be supplied via terminals 422*a* and 422*b*, as described in reference to FIGS. 1 and 3. Additionally temperature sensors 480 and pressure sensors 485 may be placed in or proximate to the shape memory device 400 and utilized by the controller 190 to control the heating of the heating element 420, as described in reference to FIG. 1.

Figure 5:
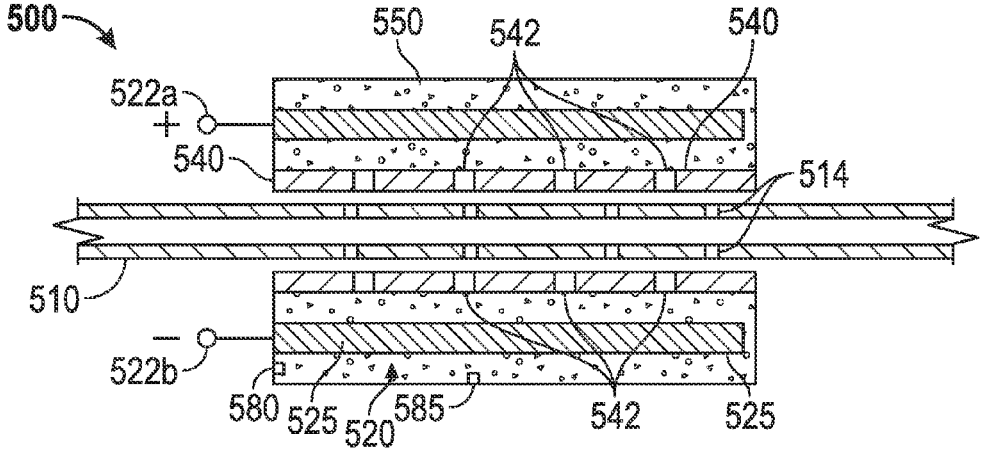
FIG. 5 shows a shape memory device that includes one or more heat strips or rods embedded in the shape memory material to heat such material, according to yet another embodiment of the disclosure.

FIG. 5 shows a shape memory device 500 made according to yet another embodiment of the disclosure. The shape memory device 500 is shown placed around fluid passages 514 in a base pipe 510. In one aspect, the shape memory device 500 includes a shape memory member or material 550 placed around or attached around to a tubular 540 having fluid flow passages 542. A heating element 520 containing one or more conductive strips 525 may be embedded or partially embedded in the shape memory material 550 during manufacturing of the shape memory device 500. The electrical energy to the heating element 520 may be supplied via terminals 522*a* and 522*b*, as described in reference to FIG. 1. Additionally, temperature sensors 580 and pressure sensors 585 may be placed in or proximate to the shape memory device 500 and utilized by the controller 190 to control the heating of the heating element 520, as described in reference to FIG. 1.

It should be understood that FIGS. 1-5 are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. An apparatus for use in a wellbore, comprising:

a downhole tool conveyable in the wellbore, the downhole tool comprising:

a fluid passage in the downhole tool for allowing fluid outside the downhole tool to pass into the downhole tool;

a shape memory member formed into a first compressed state over the fluid passage in the downhole tool, the shape memory device having a glass transition temperature; and a heating device associated with the shape memory member configured to heat in the wellbore the shape memory member to or above the glass transition temperature to expand the shape memory member to a second expanded state;

wherein fluid passing from outside the downhole tool into the downhole tool via the fluid passage passes through the shape memory member.

2. The apparatus of claim 1 further comprising a conveying member attached to the downhole tool for conveying the downhole tool into the wellbore.

3. The apparatus of claim 1, wherein the heating device includes a heating element and a power source for activating the heating element.

4. The apparatus of claim 3, wherein the power source is selected from a group consisting of: a battery in the downhole tool; and a power line in the conveying member that supplies electrical energy from a surface location to the heating element.

5. The apparatus of claim 1 further comprising a sensor for providing signals relating to a parameter of interest relating to expansion of the shape memory member in the wellbore.

6. The apparatus of claim 5, wherein the parameter of interest is selected from a group consisting of: temperature; and pressure.

7. The apparatus of claim 5 further comprising a controller that receives signals from the sensor and in response thereto controls heating of the shape memory member.

8. The apparatus of claim 1, wherein the heating device includes a heating element that is selected from a group consisting of: a heating element downhole and uphole of the shape memory member configured to heat a fluid in the wellbore proximate to the shape memory member to a selected temperature; a heating element at least partially embedded in the shape memory member; and a heating element placed on a tubing inside the shape memory member.

9. The apparatus of claim 1, wherein the heating device includes a heating element selected from the group consisting of: a coil placed around a tubular associated with the shape memory member; a coil at least partially embedded inside a shape memory member; a heat conducting strip placed on a tubular associated with the shape memory member; and a heat conducting strip at least partially embedded inside the shape memory member.

10. A work string disposed in a wellbore, comprising:

a conveying member conveyed from a surface location into the wellbore;

a tool coupled to the conveying member and placed at a selected location in the wellbore, the tool comprising:

a fluid passage for allowing fluid to pass from outside the tool to inside the tool;

a shape memory member placed over the fluid passage that expands from a compressed shape to an expanded shape when the shape memory member is heated to a selected temperature, wherein the fluid passing through the fluid passage from outside the tool to inside the tool passes through the shape memory member; and a heating device that heats the shape memory member to the selected temperature.

11. The work string of claim 10, wherein the shape memory member is formed on a metallic tubular disposed outside of a tubing associated with the conveying member.

12. The work string of claim 10, wherein the heating device is selected from a group consisting of: a coil placed around a tubular associated with the shape memory member; a coil at least partially embedded inside a shape memory member; a heat conducting strip placed on a tubular associated with the shape memory member; and a heat conducting strip at least partially embedded inside the shape memory member.

13. The work string of claim 10 further comprising a power source for supplying electrical energy to the heating element.

14. A device for use in a wellbore, comprising:

a base pipe having a fluid flow passage;

a shape memory member placed around the base pipe and over the fluid flow passage that expands from a compressed shape to an expanded shape when the shape memory member is heated to a selected temperature;

a heating element placed proximate or in the shape memory member that heats the shape memory member to the selected temperature; and a source proximate or embedded in the shape memory member that supplies electrical energy to the heating element to heat the shape memory member to or above a glass transition temperature of the shape memory member;

wherein fluid from outside the base pipe passes through the shape memory member to pass through the fluid flow passage into the base pipe.

15. A method of providing an apparatus for use in a wellbore, comprising:

providing a metallic tubular including a fluid passage;

providing a shape memory member in a compressed state on the metallic tubular and over the fluid passage to form a downhole assembly, wherein the fluid passage allows fluid outside the metallic tubular to pass into the metallic tubular through the shape memory member;

placing a heating element proximate or in the shape memory member; and providing a source that supplies electrical energy to the heating element to heat the shape memory member to a selected temperature.

16. The method of claim 15, wherein providing the heating element comprises placing the heating element at a location selected from a group consisting of: downhole of the shape memory member; uphole of the shape memory member; at least partially inside the shape memory member; and on a metallic member placed within an opening in the shape memory member.

17. The method of claim 15, wherein providing the heating element comprises providing a heating element selected from a group consisting of: a coil placed around a metallic member proximate the shape memory member; a strip placed on a metallic member proximate to the shape memory member; a coil at least partially embedded in the shape memory member; a strip at least partially embedded inside the shape memory member; and heat element downhole of the shape memory member.

18. The method of claim 15 further comprising conveying the downhole assembly in the wellbore.

19. The method of claim 18 further comprising supplying electrical energy to the heating element to heat the heating element to a selected temperature for a selected time period cause the shape memory member to expand from the compressed state.

20. A method of producing fluid from a wellbore formed in a formation, comprising:

providing a work string containing a tool conveying member and a tool attached thereto, the tool including:

a fluid passage in the tool allowing fluid outside the tool to pass into the tool;

a shape memory member in a compressed state placed over the fluid passage, a heating element configured to heat the shape memory member when the shape memory member is in the wellbore, and conveying the work string into the wellbore and locating the tool at a selected location in the wellbore;

supplying electrical energy to the heating element to heat the shape memory member for a selected time period to expand the shape memory member from the compressed state; and producing the fluid from the wellbore by passing the fluid through the expanded shape memory member, through the fluid passage and into the tool.

* * * * *